US009873194B2

(12) United States Patent
Bolivar

(10) Patent No.: US 9,873,194 B2
(45) Date of Patent: Jan. 23, 2018

(54) WRENCH EXTENSION TOOL

(71) Applicant: Carlos Bolivar, Gilbert, AZ (US)

(72) Inventor: Carlos Bolivar, Gilbert, AZ (US)

( * ) Notice: Subject to any disclaimer, the term of this patent is extended or adjusted under 35 U.S.C. 154(b) by 259 days.

(21) Appl. No.: 14/545,471

(22) Filed: May 8, 2015

(65) Prior Publication Data

US 2016/0325426 A1 Nov. 10, 2016

(51) Int. Cl.

| | |
|---|---|
| ***B25G 1/04*** | (2006.01) |
| ***B25B 23/16*** | (2006.01) |
| ***B25G 1/00*** | (2006.01) |
| ***B25B 13/08*** | (2006.01) |

(52) U.S. Cl.

CPC ..... *B25G 1/005* (2013.01); *B25B 13/08* (2013.01)

(58) Field of Classification Search

CPC ..... B25G 1/005; B25G 1/043; B25G 3/24; B25G 1/06; B21F 1/002

USPC ..... 81/177.2, 125.1; 16/429, 427; 254/130, 254/29 R, 19, 21, 25

See application file for complete search history.

(56) References Cited

U.S. PATENT DOCUMENTS

| | | | | |
|---|---|---|---|---|
| 893,276 | A | 7/1908 | Stickler | |
| 905,650 | A | 12/1908 | Clarke | |
| 1,371,533 | A | 3/1921 | Wright | |
| 1,511,738 | A | 10/1924 | Lownsbery | |
| 1,689,639 | A * | 10/1928 | Neff | B25B 13/08 81/177.2 |
| 1,793,714 | A * | 2/1931 | Newberg | B25B 13/08 81/125.1 |
| 2,652,736 | A * | 9/1953 | Kiene | B25G 1/00 16/427 |
| 2,725,773 | A * | 12/1955 | Anacker | B25B 13/04 81/177.2 |
| D328,017 | S | 7/1992 | Boele | |
| 5,425,154 | A * | 6/1995 | Edwards, Jr. | B60P 7/083 16/422 |
| 5,535,649 | A * | 7/1996 | Waggle, Jr. | B25G 1/043 81/177.2 |
| 5,832,794 | A | 11/1998 | Fowler | |
| D476,203 | S | 6/2003 | Mahan | |
| 6,845,692 | B2 * | 1/2005 | Cooper | B25G 1/043 81/177.2 |
| D598,257 | S | 8/2009 | Darby | |
| D630,481 | S | 1/2011 | Hutt | |
| 8,297,154 | B2 * | 10/2012 | Chen | B25B 13/04 81/177.1 |
| 8,931,376 | B2 | 1/2015 | Humphrey | |
| 2013/0098211 | A1 * | 4/2013 | Sampson, Sr. | B25G 1/005 81/177.2 |

(Continued)

OTHER PUBLICATIONS http://www.matcotools.com/catalog/product/WE745/WRENCH-EXTENDER/.
http://www.maxx-leverage.com/.
http://www.mueller-kueps.com/product-catalog/all-tools/uni-ex-tender-type-1/.

*Primary Examiner* — Bryan R Muller
(74) *Attorney, Agent, or Firm* — Schmeiser, Olsen & Watts, LLP

(57) ABSTRACT

A wrench extension tool for application to a dual open end wrench to increase leverage applied to the wrench and providing multiple position attachments to the end of the open end wrench opposite the end applied to an object removed or applied upon a threaded bolt, stud or shaft, having a variety of attachment positions to the wrench as selected for optimizing application to the open end wrench by a user.

3 Claims, 4 Drawing Sheets

(56) References Cited

U.S. PATENT DOCUMENTS

| | | | | |
|---|---|---|---|---|
| 2015/0251305 | A1* | 9/2015 | Mulligan | B25G 1/043<br>81/177.2 |
| 2015/0258665 | A1* | 9/2015 | East | B25B 13/48<br>81/124.4 |
| 2016/0129580 | A1 | 5/2016 | Klimsza | |

* cited by examiner

WRENCH EXTENSION TOOL

CROSS REFERENCE TO RELATED APPLICATIONS

None.

I. BACKGROUND OF THE INVENTION

1. Field of Invention

A wrench extension tool for application to a dual open end wrench to increase leverage applied to the wrench and providing multiple position attachments to the end of the open end wrench opposite the end applied to a nut on a threaded bolt or shaft, the attachment position selected for optimizing access to the open end wrench by a user.

2. Description of Prior Art

A preliminary review of prior art patents was conducted by the applicant which reveal prior art patents in a similar field or having similar use. However, the prior art inventions do not disclose the same or similar elements as the present wrench extension tool, nor do they present the material components in a manner contemplated or anticipated in the prior art.

In U.S. Pat. No. 905,650 to Clarke, and early version of a wrench extension is disclosed, a U-shaped housing provides a channel extending from a flattened handle to accept the handle of a single open end wrench with a stud projecting from one side of the flattened portion bent in the form of a hook to engage and bear against the handle of the wrench, as shown in FIG. 1 of that patent.

Another early patent, U.S. Pat. No. 1,689,639 to Neff, depicts a wrench extension adapting a double open end wrench, shown in FIG. 1, with a single stud across and open channel to accept the non-used tool end of the wrench, with a groove to accept a neck of the wrench and the single stud across the channel to either receive the handle end of the double end wrench or the shoulder of the handle end of the double end wrench, providing two positioning selections on the wrench. It has one single tool end and a handle end. Likewise, U.S. Pat. No. 1,371,533 to Wright, provides a single wrench end defining a socket, a lower notch or abutment, and a stirrup or fulcrum portion, the socket receiving the non tool end of a double end wrench, with the notch or abutment placed for insertion within the jaw end of the wrench for which the extension is adapted, as shown in FIGS. 1 and 2 of the drawings. A more recent U.S. Patent Application, Pub. No. 2013/0098311 to Sampson, Jr., a single peg across a slotted channel receives the handle end of a double end wrench, with the open end of the handle end wrench placed upon the peg and a floor portion at the presenting front end of the channel being applied against the handle portion of the double end wrench with the extension tool being applied to either loosen or tighten the wrench object, shown in FIG. 3 as a hex head of a bolt. It is presumed the intended wrench is either a double box end wrench or a wrench having at least one box end.

The present wrench extension tool is distinguishable from the observed prior art. The present extension tool provides two differently placed bars spanning the channel opening, the tool having a first end for a wrench of one size and a second end for a wrench of a different size, most commonly applied to wrenches having corresponding open ends adapted to two paired sizes of nuts or bolts. Most of the wrenches provided in a tool set, by example, may include a first end ½ inch open end wrench with a second end 9/16 inch open end wrench. The properly sized extension tool would have the first end to mate with the 9/16 end of the dual open end wrench and the second end to mate with the ½ end of the dual open end wrench. Thus, the inclusion of dual open ends on the present extension tool is not a mere duplication of same elements, but an actual purposeful inclusion of a different sized end for a different sized open ends of a dual end open wrench. The present tool, by the inclusion of the two pins on opposing upper and lower surfaces the channel instead of a single pin found in Sampson and Neff, allows for additional positioning opportunities of the present tool, which will subsequently shown in FIG. 6-9 of the drawings accompanying this application. Once again, the inclusion of two pins instead of one is not a mere duplicity of same components, but with functional additions which provides for expanded uses and applications. More distinctions will be demonstrated throughout the drawings, specifications and claims.

II. SUMMARY OF THE INVENTION

Extension and leverage devices are applied to hand tools to allow a user to increase the amount of torque or force applied to the hand tool. These extensions are applied to frozen nuts and bolts, seized threaded nuts and bolts, or other rotationally threaded objects to loosen them, or to applying a finishing turn to ensure the nut or bolt is sufficiently set upon the threads.

The present extension tool is applied to a specific dual open end wrench, preferably being supplied with a first end of one dimension open end wrench and a second end of a different dimension open end wrench. The example for the targeted wrench above, that wrench having a ½ inch open wrench on one end and a 9/16 inch open end wrench within a set of dual open end wrenches. The extension tool is not intended for single end box wrenches, combination dual end wrenches which provide a box end wrench and an open end wrench of the same size on a common tool, or for dual end box wrenches.

Wrench sets, especially those having dual ends, are provided in standard inch increments or metric increments. For example, a set of wrenches provides attachment to sizes ranging from ⅛" through 1", or 2 mm through 20 mm. To compact these tool sets, pair sizes and provided on a single tool, thus providing definition here and throughout the specification and claims as a dual open end wrench. The purposeful inclusion of two different dimensional ends mated to a dual open end wrench matches the extension to a specific dual box end wrench. The provision and orientation of the dual pins spanning a common channel on each end also provides for at least four selections of positional engagement between the dimension tool socket of the extension tool and the handle end of the dual open end wrench, as necessarily determined by the user of the extension tool.

III. DESCRIPTION OF THE DRAWINGS

The following drawings are submitted with this utility patent application.

FIG. 8 is a cross sectional view of the extension tool engaging an open end of a wrench inserted within the tool channel opening with the open end wrench opening engaging the forward pin and the lower edge of the front shoulder panel of the tool channel opening, positioning the wrench and extension tool and a slight lower angle.

FIG. 9 is a cross sectional view of the extension tool engaging an open end of a wrench inserted within the tool channel opening with the open end wrench opening engaging the rear pin and the shoulder of the open end wrench applied against the forward pin within the tool channel opening, positioning the wrench and extension tool at a greater lower angle.

IV. DESCRIPTION OF THE PREFERRED EMBODIMENT

Figure 1:
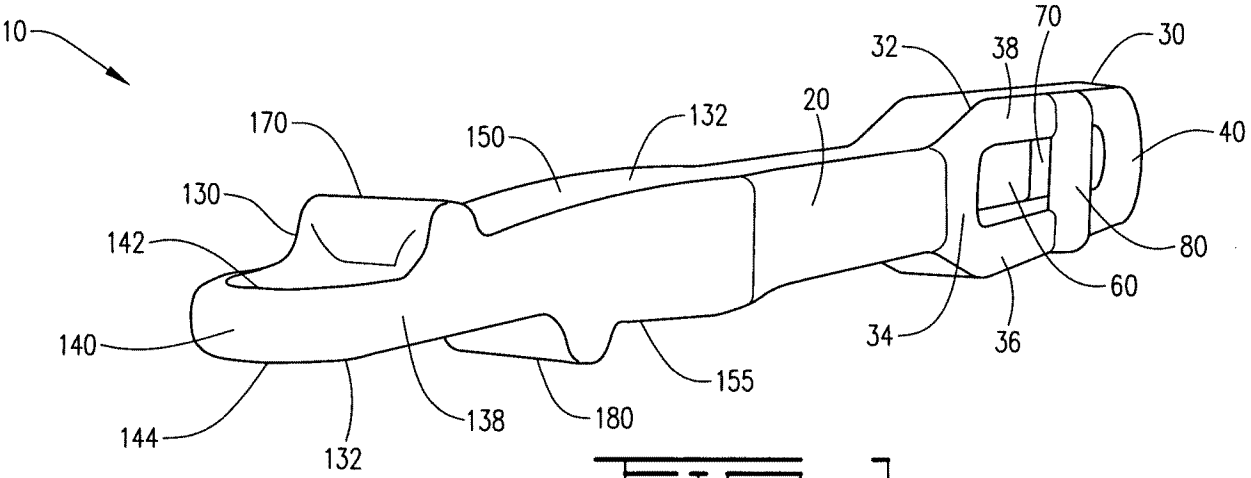
FIG. 1 is a perspective first end view of the wrench extension tool.
Figure 2:
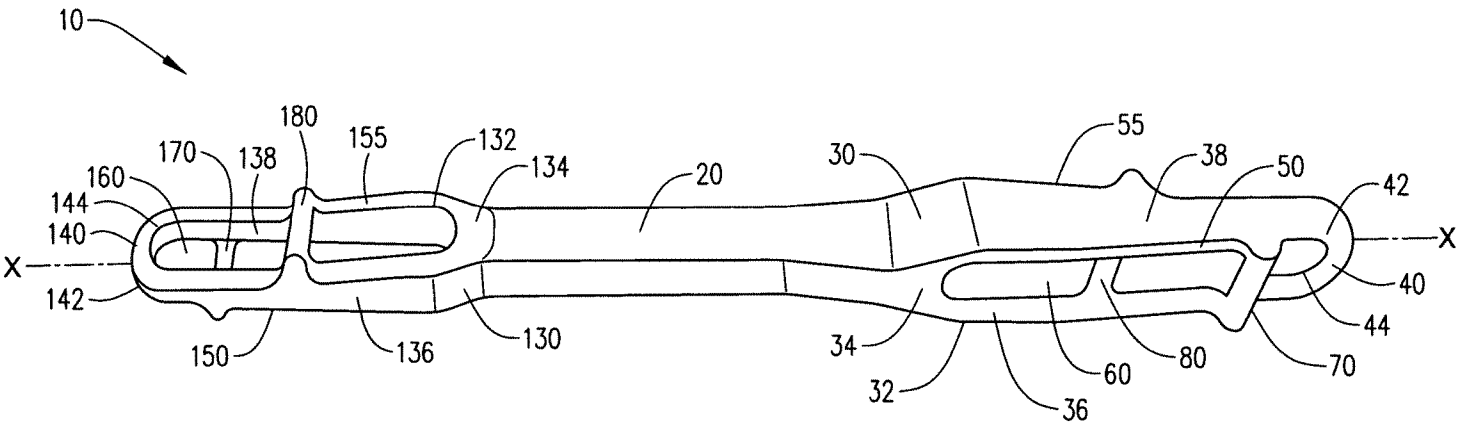
FIG. 2 is a side perspective view of the wrench extension tool.
Figure 3:
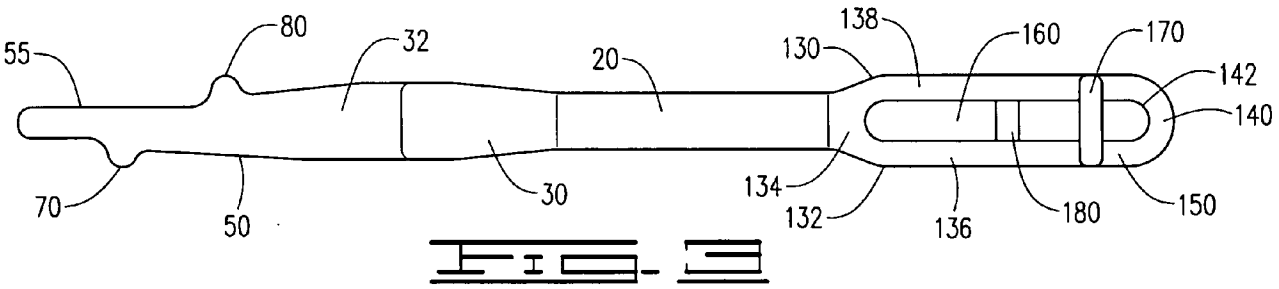
FIG. 3 is a side view of the wrench extension tool.
Figure 4:
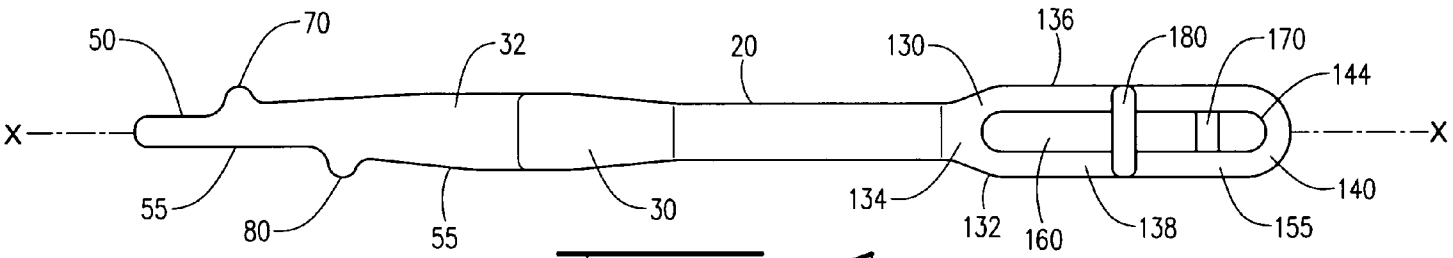
FIG. 4 is a reverse side view of the wrench extension tool shown in FIG. 3.
Figure 5:
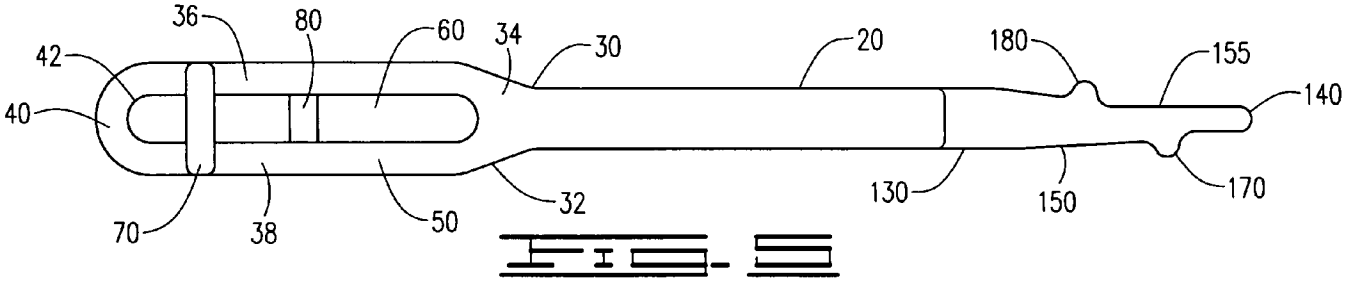
FIG. 5 is a 90 degree side view of the wrench extension tool shown in FIG. 3.
Figure 6:
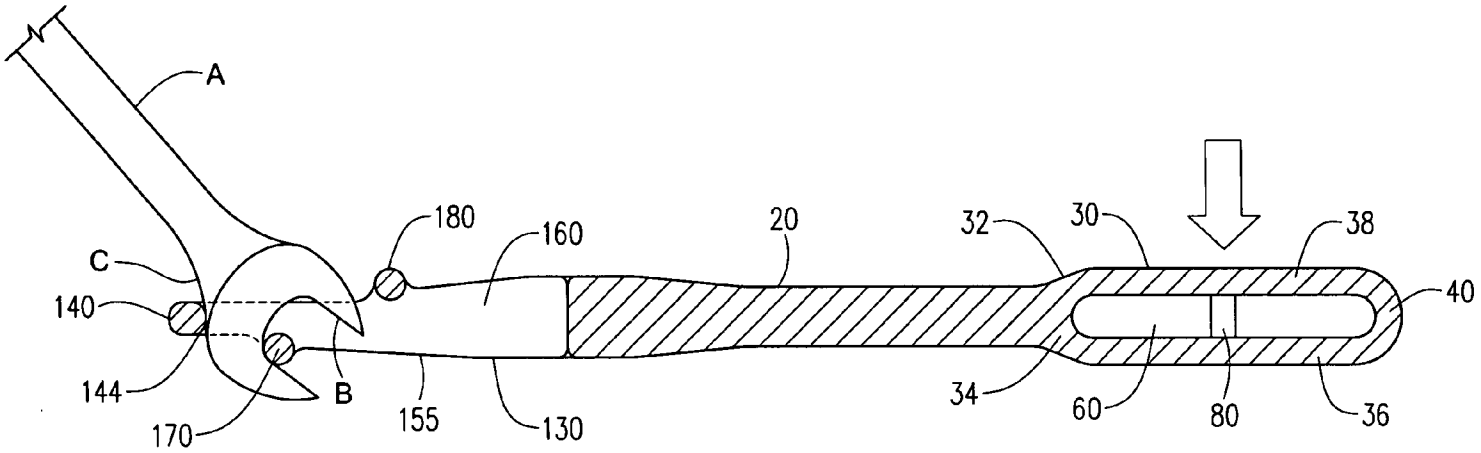
FIG. 6 is a cross sectional view of the extension tool engaging an open end of a wrench inserted within the tool channel opening with the open end wrench opening engaging the forward pin and the upper edge of the front shoulder panel of the tool channel opening, forming an upward angle between the wrench and the extension tool.

A wrench extension tool 10 for an enhanced application of force and torsion upon a dual open end wrench A, shown in FIGS. 1-9 of the drawings, the tool 10 defining a body 20, a first tool end 30 and a second tool end 130, each tool end providing a tool channel 32, 132, defining a body transition portion 34, 134, a right side panel 36, 136, a left side panel, 38, 138, a front panel 40, 140, defining an upper edge 42, 142, and a lower edge, 44, 144, each said tool channel 32, 132, further defining upper surface 50, 150, a lower surface 55, 155, and a tool channel opening 60, 160. Spanning each tool channel opening 60, 160 is a first pin 70, 170, attached proximate to the front panel 40, 140, on the upper surface 50, 150, and a second pin 80, 180, attached proximate to the body transition portion 34, 134, on the lower surface 55, 155, FIGS. 3-5. The first tool end 30 and the second tool end 130 are set 90 degrees laterally from one another along the longitudinal axis $\chi$ of the extension tool 10.

Each first pin 70, 170, is preferably provided with a rounded profile, as shown in the cross sectional views of FIGS. 6-9, as would each preferably second pin, 80, 180. Additionally, the front panel 40, 140, would also preferably be preferably rounded. Each tool channel opening 32 is dimensionally proportional to a corresponding open end wrench size, and in metric or standard sizes. The first tool end 30 is a different size than the second tool end 130, each tool end being sized to correspond to the sizes of a dual open end wrench to which the extension tool 10 is designated to fit.

It is preferred that the extension tool 10 be cast, molded or forged and provided with a sufficient strength to avoid deformation when large amounts of torsion or force is applied to the extension tool 10 and wrench A. It would be preferred that the linear strength of the extension tool 10 be equal to the linear strength of the dual open end wrench A, which would be made of a material with a high level of hardness on hardness scale recognized by those skilled in the tool industry.

The provision and orientation of the first pins 70, 170, and second pins 80, 180, spanning a common channel 32, 132, on each end also provides for at least four selections of positional engagement between each dimension tool channels 32, 132, of the extension tool 10 and wrench end B of the dual open end wrench A, as necessarily determined by the user of the extension tool. FIGS. 6-9 provide cross sectional dimensional representations of the variety of open end wrench engagements with the extension tool 10, as defined within the definitions accompanying the drawing figures.

Figure 7:
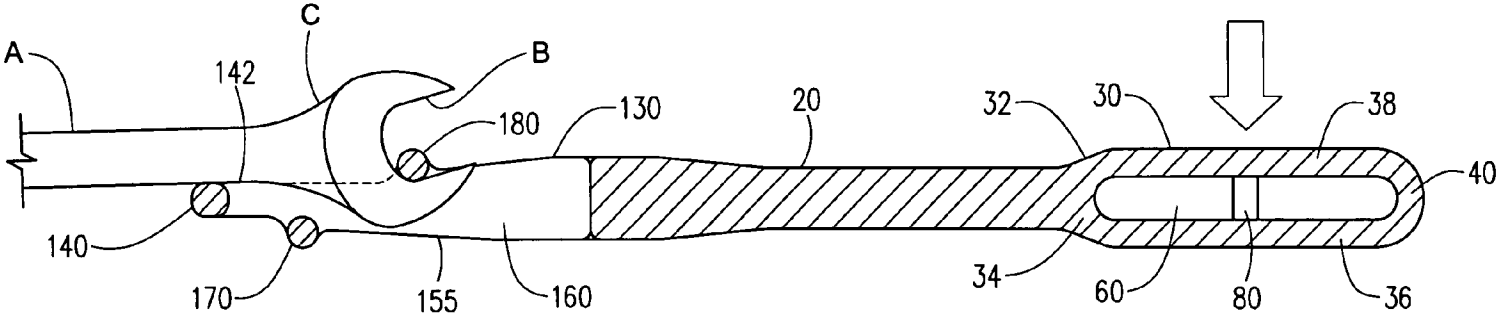
FIG. 7 is a cross sectional view of the extension tool engaging an open end of a wrench inserted within the tool channel opening with the open end wrench opening engaging the rear pin and the upper edge of the front shoulder panel of the tool channel opening, positioning the wrench and extension tool in a straight line.
Figure 4:
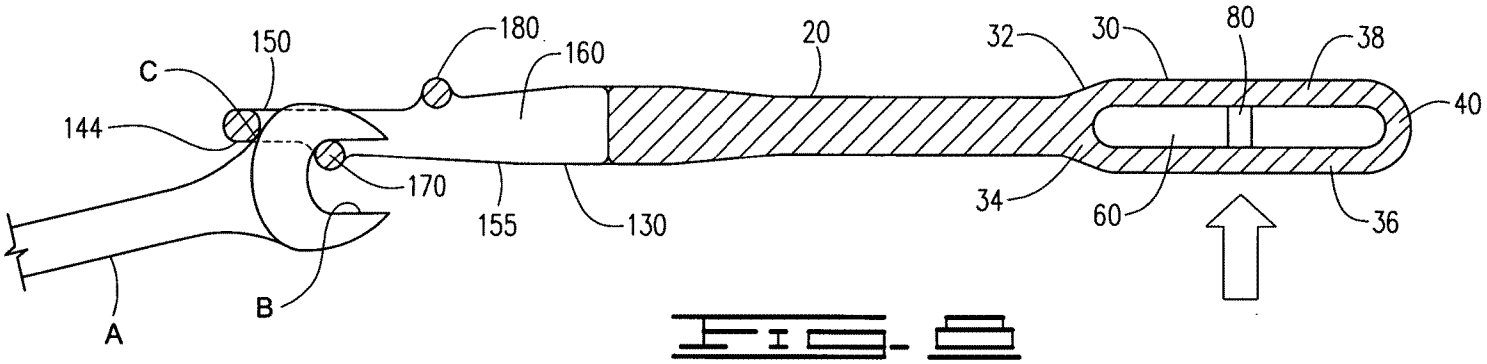
Figure 3:
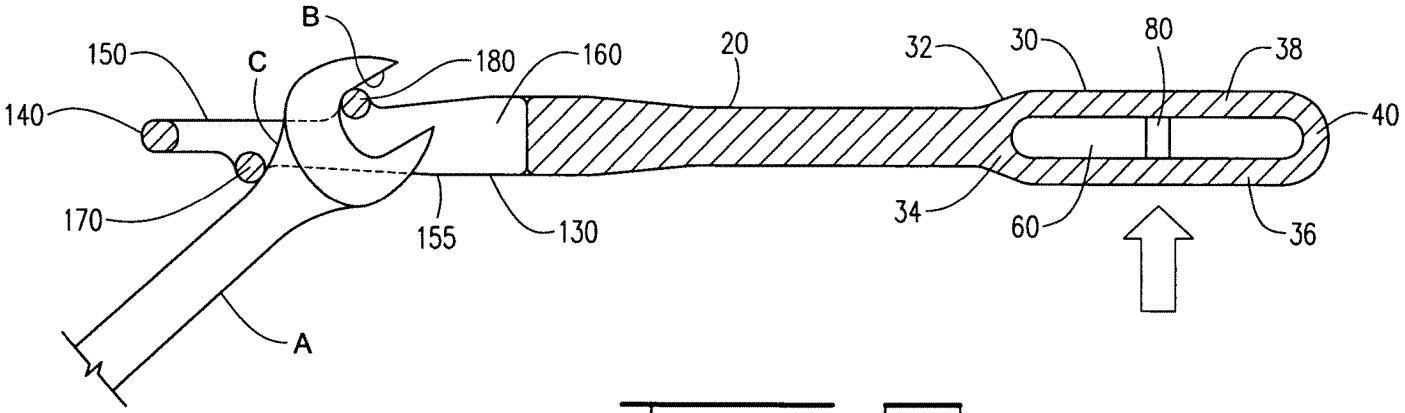

FIG. 6-FIG. 9, all depict the engagement between a dual open end wrench A and the second tool end 130, although it should be known that the first tool end 130 would adapt to the first tool end 30 of said dual open end wrench A in the same manner, although having a different dimension. A first engagement position, shown in FIG. 6, demonstrates the extension tool 10 engaging a wrench opening B of a dual open end wrench A inserted within the tool channel opening 160 with the open end wrench opening B around the first pin 170 and the wrench neck C, forced against the upper edge 142 of the front panel 140 of the tool channel, forming an upward angle between the wrench and the extension tool. A second engagement, shown in FIG. 7 shows the extension tool 10 engaging the open end wrench A inserted within the tool channel opening 160 with the open end wrench opening B engaging the second pin 180 with the wrench neck C abutting the upper edge 142 of the front panel 140 of the tool channel opening 160, positioning the wrench and extension tool in a straight line. A third anticipated engagement, shown in FIG. 8, engaging an open end B of the dual open end wrench A inserted within the tool channel opening 160 with the open end wrench opening B engaging the first pin and the lower edge 144 and the wrench neck C abutting the front panel 140 of the tool channel 132, positioning the wrench and extension tool and a slight lower angle. A fourth engagement, shown in FIG. 9 discloses the extension tool 10 engaging an open end B of the dual open end wrench A inserted within the tool channel opening 160 with the open end wrench opening B engaging the second pin 180 and the shoulder C of the open end wrench A applied against the first pin 170 within the tool channel 132, positioning the wrench and extension tool at a greater lower angle.

The selection of attachment by the user is determined by the position of the wrench and the accessibility of the user to the current selected end being engaged by the extension tool of the wrench within the confines of the space where the wrench is being used. It also is adjusted based upon the user loosening an object, as shown in the drawing figures by a directional arrow, or tightening an object, which would use a force opposite that shown in those drawing figures. It is essential that the first and second tool ends are not adapted to the same dimension in order to avoid the tool having a first and second end that would constitute a mere duplication of essential parts. Each tool end must be specifically adapted different size wrench. It should also be pointed out that each tool end would be greater in circumference larger than the body which connect the first and second end. This greater circumference of each tool end provides for an enhanced hand grip location for the extension tool than a straight handle, which is an ergonomic benefit know by those skilled in the art of hand tools, when the first tool end is being used on a wrench and the second tool end used as a hand grip location vice versa.

While the invention has been particularly shown and described with reference to a preferred embodiment thereof, it will be understood by those skilled in the art that changes in form and detail may be made therein without departing from the spirit and scope of the invention.

What is claimed is:

1. A wrench extension tool for an enhanced application of force and torsion upon a dual open end wrench, said tool comprising:

a body, a first tool end and a second tool end, each said tool end comprising a tool channel, a right side panel, a left side panel, a front panel and rear panel an upper edge of the right side panel, left side panel, front panel and rear panel forming an upper surface with an upper surface tool channel opening, a lower edge of the right side panel, left side panel, front panel and rear panel forming a lower surface with a lower tool channel opening and the tool channel defined by inner surfaces of the right side panel, left side panel, front panel and rear panel;

a first pin attached to said upper surface across said upper tool channel opening of each tool end, wherein said first pin is attached proximate to said respective front panel; and a second pin attached across said lower tool channel opening of each tool end, wherein said second pin is attached to said lower surface closer to the respective rear panel than the respective first pin; and wherein a majority of each of said first and second pins is positioned external to the tool channel;

wherein said first tool end and said second tool end are rotationally offset at 90 degrees laterally from one another about a longitudinal axis of said body of said extension tool, and each said tool channel opening is dimensionally proportional to accept a corresponding open end wrench size, in metric or standard sizes, with said first tool end of a different size than said second tool end, each tool end being adapted to a size of each end of said dual open end wrench to which said extension tool is designated to mate with and fit.

2. The extension tool of claim 1, further comprising each said front panel and said first and second pin having a rounded profile, each said front panel and said first and second pin combination and orientation providing for at least four selections of positional engagement between said tool channel and said chosen gripped end of said dual open end wrench as chosen by said user of said extension tool.

3. The extension tool of claim 1, wherein, a circumference of a cross-section of each said tool end is greater than a cross-sectional circumference of said body of said extension tool connecting said first and second ends, providing an enhanced hand grip of said extension tool.

* * * * *